US009997343B2

(12) United States Patent
Ding et al.

(10) Patent No.: US 9,997,343 B2
(45) Date of Patent: Jun. 12, 2018

(54) MASS ANALYSER AND METHOD OF MASS ANALYSIS

(71) Applicant: SHIMADZU CORPORATION, Kyoto (JP)

(72) Inventors: Li Ding, Sale (GB); Mikhail Sudakov, St. Petersburg (RU); Sumio Kumashiro, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days. days.

(21) Appl. No.: 15/618,959

(22) Filed: Jun. 9, 2017

(65) Prior Publication Data

US 2017/0278689 A1 Sep. 28, 2017

Related U.S. Application Data

(62) Division of application No. 14/877,593, filed on Oct. 7, 2015, now Pat. No. 9,691,596, which is a division (Continued)

(30) Foreign Application Priority Data

Feb. 28, 2011 (GB) ..... 1103361.0

(51) Int. Cl.
*H01J 49/40* (2006.01)
*H01J 49/02* (2006.01)
(Continued)

(52) U.S. Cl.
CPC ..... *H01J 49/027* (2013.01); *H01J 49/0031* (2013.01); *H01J 49/061* (2013.01);
(Continued)

(58) Field of Classification Search
CPC ..... H01J 49/406; H01J 49/027; H01J 49/408; H01J 49/40; H01J 49/4235
See application file for complete search history.

(56) References Cited

U.S. PATENT DOCUMENTS 5,420,425 A * 5/1995 Bier ..... H01J 49/423 250/282
5,455,418 A * 10/1995 Hogan ..... H01J 49/38 250/281

(Continued)

*Primary Examiner* — Wyatt Stoffa
(74) *Attorney, Agent, or Firm* — Stephen J. Weyer, Esq.; Stites & Harbison, PLLC

(57) ABSTRACT

An electrostatic ion trap for mass analysis includes a first array of electrodes and a second array of electrodes, spaced from the first array of electrode. The first and second arrays of electrodes may be planar arrays formed by parallel strip electrodes or by concentric, circular or part-circular electrically conductive rings. The electrodes of the arrays are supplied with substantially the same pattern of voltage whereby the distribution of electrical potential in the space between the arrays is such as to reflect ions isochronously in a flight direction causing them to undergo periodic, oscillatory motion in the space, focused substantially mid-way between the arrays. Amplifier circuitry is used to detect image current having frequency components related to the mass-to-charge ratio of ions undergoing the periodic, oscillatory motion.

5 Claims, 19 Drawing Sheets

Related U.S. Application Data of application No. 14/001,747, filed as application No. PCT/EP2011/066880 on Sep. 28, 2011, now Pat. No. 9,159,544.

(51) Int. Cl.
*H01J 49/42* (2006.01)
*H01J 49/00* (2006.01)
*H01J 49/06* (2006.01)

(52) U.S. Cl.
CPC ..... *H01J 49/4245* (2013.01); *H01J 49/406* (2013.01); *H01J 49/408* (2013.01)

(56) References Cited

U.S. PATENT DOCUMENTS 6,888,130 B1 * 5/2005 Gonin ..... H01J 49/027 250/281
7,078,679 B2 * 7/2006 Westphall ..... H01J 49/027 250/287
7,723,679 B2 * 5/2010 Tolley ..... H01J 49/424 250/281
7,888,633 B2 * 2/2011 Franzen ..... H01J 49/0036 250/281
2005/0092919 A1 * 5/2005 Bellec ..... H01F 7/0278 250/290
2006/0214100 A1 * 9/2006 Verentchikov ..... H01J 49/406 250/287
2006/0232369 A1 * 10/2006 Gorshkov ..... G01R 33/3806 335/306
2007/0228270 A1 * 10/2007 Yamaguchi ..... H01J 49/004 250/287
2008/0035842 A1 * 2/2008 Sudakov ..... H01J 49/004 250/287
2008/0067349 A1 * 3/2008 Moskovets ..... H01J 49/009 250/287
2008/0210859 A1 * 9/2008 Tolley ..... H01J 49/4235 250/282
2009/0020694 A1 * 1/2009 Flory ..... H01J 49/027 250/282
2009/0078866 A1 * 3/2009 Li ..... H01J 49/425 250/297
2009/0218485 A1 * 9/2009 Kaiser ..... H01J 49/38 250/283
2010/0044558 A1 * 2/2010 Sudakov ..... H01J 49/406 250/281
2010/0072362 A1 * 3/2010 Giles ..... H01J 49/4295 250/287
2010/0072363 A1 * 3/2010 Giles ..... H01J 49/406 250/287
2011/0180702 A1 * 7/2011 Flory ..... H01J 49/406 250/282
2011/0240845 A1 * 10/2011 Ding ..... H01J 49/027 250/282
2011/0248161 A1 * 10/2011 Takeshita ..... H01J 49/004 250/287
2012/0267523 A1 * 10/2012 Lammert ..... H01J 49/0013 250/283
2013/0068942 A1 * 3/2013 Verenchikov ..... H01J 49/4245 250/282

* cited by examiner

MASS ANALYSER AND METHOD OF MASS ANALYSIS

CROSS REFERENCE TO RELATED APPLICATIONS

This is a divisional of U.S. application Ser. No. 14/877,593, filed Oct. 7, 2015 and issued as U.S. Pat. No. 9,691,596 on Jun. 27, 2017, which is a divisional of U.S. application Ser. No. 14/001,747, having a filing date of Apr. 9, 2014, which is a 371 application of PCT/EP2011/066880, filed Sep. 28, 2011, and which issued as U.S. Pat. No. 9,159,544 on Oct. 13, 2015, said applications incorporated herein by reference.

FIELD OF THE INVENTION

This invention relates to a mass analyser and a method of mass analysis, particularly a mass analyser and method utilizing an iso-trap.

BACKGROUND OF THE INVENTION

Many types of mass analyser have been developed to date and they can be divided into two categories depending on the way they detect an ion signal. One category of mass analyser, referred to as a destructive detection mass analyser employs a Faraday cup or secondary electron multiplier and has been widely used in quadrupole or quadrupole ion trap mass spectrometers, in sector magnetic deflection mass spectrometers and in time-of-flight mass spectrometers. In these mass spectrometers, following the selection/separation process in the analyser, ions splash onto the electrode of the detector and disappear.

Another category of mass analyser, referred to as a non-destructive detection mass analyser, normally detects an induced charge in a pick-up electrode which is called the image charge detector. The induced image charge varies when the measured ion is passing by the detector surface resulting in an image current in a circuit connected to the measuring device. Such methods have been used in FTICR, first disclosed in M. B. Comisarow and A. G. Marshall, Chem. Phys. Lett. 25, 282 (1974), and were introduced later into the so-called Orbitrap by Alexander Makarov, disclosed in Anal. Chem., 2000, 72 (6), pp 1156-1162. In these devices the ions that contribute to image current being detected are not lost during the detection procedure so they can be measured many times in the analyser, giving rise to a higher mass resolution and better mass accuracy.

An electrostatic ion trap is more attractive because it avoids use of a high strength and high stability superconducting magnet. The Orbitrap is one example of an electrostatic ion trap where ions can keep oscillating in the axial direction while, at the same time, rotating around a central spindle-shaped electrode. To keep the axial oscillations harmonic, the central and outer electrodes of the Orbitrap need to be very accurately machined so as to achieve a so-called hyper-logarithmic potential inside the trap volume. In U.S. Pat. No. 7,767,960B2, Makarov disclosed some alternative forms to create the hyper-logarithmic potential where an array of cylindrical electrodes are used to mimic a single, complex-shaped electrode, so that any machining error might be compensated electrically using a "tuning procedure".

It is not necessary for the electrostatic trap to have a field structure that allows ions to perform harmonic motion in any one direction, such as in the Orbitrap. An electrostatic ion beam trap (EIBT), which uses isochronous mirrors, can also be used for mass analysis with image charge detection. Strehle Frank in DE4408489A disclosed a coaxial, double mirror, multi-turn trapping device that can be used for mass analysis by Fourier transformation of the image current detected by a pair of pick up electrodes. H. Benner in U.S. Pat. No. 5,880,466A disclosed an analyser having a single, cylindrical pick-up electrode for highly charged protein analysis. Zajfman WO02103747 (A1) also disclosed a modified device of the same form for general mass analysis.

One of the big issues in image current detection using an electrostatic trap is the dynamic range of the ion signal. The minimum detectable mass peak relates to the induced image charge derived from the number of ions, having the same mass to charge ratio, that is comparable to the noise of the detection circuit, and so far this is down to about 10 ions in the Orbitrap. The upper limit of the mass peak, on the other hand, is defined by the space charge derived from the number of ions in the mass peak that affects the measurement of a neighboring peak. This is normally about 10,000 for high mass resolution measurement.

To reduce the lower detection limit, use of multiple pick-up cylinders and a new conversion algorithm making use of multiple harmonic components in the image current signal have been proposed by Ding in US patent application 200810207492.6. While these developments have the potential to improve the resolution and the lower detection limit, the use of a narrow beam type of reflector and cylindrical pick-up electrodes restricts the maximum number of ions that can oscillate in the device without suffering space charge effects.

In US patent application US 2010/0044558 A1 Sudakov disclosed a multiple reflection time-of-flight device constructed by using a pair of planar electrode arrays. Ions are reflected in a flight direction (x) by two mirrors formed by parallel electrode strips in the planar arrays, and in a drift direction (z) by one mirror formed by another set of electrode strips on the same planar arrays. Isochronous motion of ions of the same mass-to-charge ratio is achieved in the (x-axis) flight direction within each cycle, but only for one reflection in the (z-axis) drift direction. As the ions are not tightly focused in the drift direction, Coulomb interaction between the ions is relatively small, thus giving rise to a higher space charge tolerance.

It would be desirable to have a multiple reflection type of electrostatic ion trap with image current detection for use as a mass analyser, which combines the merits of easy construction, ease of ion injection, high space charge capacity, high sensitivity (lower limit of detection) as well as high mass resolution.

SUMMARY OF INVENTION

According to one aspect of the invention, there is provided an electrostatic ion trap for mass analysis comprising: a first array of electrodes and a second array of electrodes, spaced from the first array of electrodes, voltage being supplied, in use, to electrodes of the first and second arrays of electrodes to create an electrostatic field in the space between the electrode arrays, wherein electrodes of the first array and electrodes of the second array are supplied, in use, with substantially the same pattern of voltage whereby the distribution of electrical potential in said space is such as to reflect ions isochronously in a flight direction, causing them to undergo periodic, oscillatory motion in said space, focused substantially mid-way between said first and second arrays, and wherein at least one electrode of said arrays is connected to amplifier circuitry for detection of image current having frequency components related to the mass-to-charge ratio of ions undergoing said periodic, oscillatory motion in said space between the first and second arrays of electrodes.

The arrays of electrodes create electric field for ion reflection at opposite ends of the ion trap. At least after one or consecutive reflections at the ion mirrors, ions having the same mass-to-charge ratio reach the so-called isochronous condition. Ions having the same mass-to-charge ratio undergo oscillatory motion at a fixed oscillation frequency. However, because of the simple structure of the reflector, the oscillatory motion of the ions and the image current collected by the picked up electrodes contain many higher order frequency components. An ion trap having this feature is named the "iso-trap", because of the isochronous reflection in at least one direction of ion motion.

In some preferred embodiments, said first and second arrays of electrodes are planar arrays formed by parallel strip electrodes. Each said strip electrode may extend in a drift direction of said periodic oscillatory motion and may comprise a main segment and two end segments, and wherein a voltage difference between the main segment and the end segments creates a potential barrier for reflecting ions in the drift direction. The electrostatic ion trap may further include a linear ion trap for temporarily storing ions and then injecting stored ions into said space between the first and second arrays of electrodes. An electrostatic deflector may be positioned between said linear ion trap and said space between the first and second arrays of electrodes. Said electrostatic deflector may comprise a 2D lens and a 2D curved sector element.

In other preferred embodiments, said first and second arrays of electrodes are each formed by concentric, circular, or part-circular electrically conductive rings. Each said array of electrodes may include a circular, central electrode. The distribution of electrostatic potential in said space between said first and second arrays may be such that ions follow substantially diametral trajectories in said space.

In further preferred embodiments, said first and second arrays of electrodes conform to curved, columnar surfaces, which may be inner and outer, coaxial, cylindrical, or part-cylindrical surfaces respectively.

The electrostatic ion trap may further include a full-, or part-toroidal ion trap, or ion guide injector, respectively, for temporarily storing or guiding ions and then pulsing the ions into said space between the first and second arrays of electrodes. An electrostatic deflector may be positioned between said full-, or part-toroidal ion trap, or ion guide injector, and said space between the first and second arrays of electrodes. Said full-, or part-toroidal ion trap, or ion guide injector, may be arranged to pulse ions radially inwards into said space.

In other preferred embodiments, ions may follow near-diametral, orbital trajectories that precess about the central axis of said first and second arrays of concentric, circular or part-circular electrically conductive rings. In this case, a full- or part-toroidal ion guide injector, having a curved longitudinal axis, may be arranged to guide ions along said longitudinal axis with a pre-determined kinetic energy before injecting the ions, radially inwards, into said space between the first and second arrays of electrodes. Therefore, the injected ions have an initial tangential velocity component. The pre-determined kinetic energy may be in the range from 0.04% to 1% of the maximum kinetic energy of ions in the flight direction in said space.

The full- or part-toroidal ion trap or ion guide injector may be an electrostatic ion trap or ion guide injector. The full- or part-toroidal ion guide injector may comprise a plurality of segments that extend around said circular or part-circular electrode rings of said first and second arrays of electrodes, each said segment comprising a number of electrode plates enclosing a respective volume within said full- or part-toroidal ion guide, the electrode plates of each segment being supplied, in use, with DC voltage to create a respective DC quadrupole field within the volume of the segment such that ions are focused substantially on a longitudinal axis of the toroidal ion guide injector before being pulsed, radially inwards, into the space between the first and second arrays of electrodes. Each said segment may comprise four mutually orthogonal electrode plates, such that, in one segment, said DC quadrupole field causes focusing of ions in a first direction perpendicular to said longitudinal axis and causes defocusing of ions in a second direction perpendicular to said longitudinal axis and, in the immediately succeeding segment, said DC quadrupole field causes defocusing of ions in said first direction and focusing of ions in said second direction.

In the foregoing embodiments, the electrostatic ion trap may include a pulsed gas source for supplying buffer cooling gas to said linear ion trap or to said full-, or part-toroidal ion trap, and a pump-out channel capable of pumping gas out of the linear ion trap or said full-, or part-toroidal ion trap with a time constant in the order of 10 ms.

In yet further preferred embodiments, said first and second arrays of electrodes are both split into two separate parts connected via an electrostatic deflecting device, each said part being configured as a respective ion mirror, and wherein the ion mirrors of said parts and said electrostatic deflecting device cooperate, in operation, to reflect ions isochronously in the flight direction and to focus ions in a direction perpendicular to said electrode arrays.

The electrostatic ion trap may include a pulser for injecting ions into the space between said first and second arrays of electrodes. Said pulser may have the form of a multipole ion guide before being switched to a pulsing mode.

In some embodiments, ions are injected into said space between said first and second arrays of electrodes through a side boundary perpendicular to the flight direction.

In other embodiments, ions are injected into said space between said first and second arrays of electrodes through a boundary parallel to the flight direction.

Said linear ion trap, toroidal ion trap or pulser may be driven by high frequency switching circuitry supplying a digital trapping potential.

Said amplifier circuitry may comprise a differential amplifier having inputs coupled to different said electrodes. In preferred embodiments, said at least one electrode of said arrays for image current detection is supplied, in use, with non-zero voltage from a voltage source. And said amplifier circuitry is connected to the at least one electrode via a coupling capacitor. The amplifier circuitry may be connected to at least said central electrode.

According to another aspect of the invention, there is provided a method of mass analysis comprising the steps of: injecting ions into a mass analysis space between first and second arrays of electrodes of an electrostatic ion trap, the first array of electrodes being spaced from the second array of electrodes, supplying voltage to electrodes of the first and second arrays to create an electrostatic field in said space, electrodes of the first array and electrodes of the second array being supplied with substantially the same pattern of voltage, whereby the distribution of electrical potential in said space is such as to reflect ions isochronously in a flight direction causing them to undergo periodic, oscillatory motion in said space, focused substantially mid-way between the first and second arrays, and detecting image current on at least one electrode of said arrays, the detected image current having frequency components related to the mass-to-charge ratio of ions undergoing said periodic, oscillatory motion in said space.

According to yet another aspect of the invention there is provided an ion trap for mass analysis comprising: a first array of electrodes and a second array of electrodes, spaced from the first array of electrodes, voltage being supplied, in use, to electrodes of the first and second arrays of electrodes to create an electrostatic field in the space between the electrode arrays, a magnet for superimposing a static magnetic field on said electrostatic field, wherein electrodes of the first array and electrodes of the second array are supplied, in use, with substantially the same pattern of voltage, whereby the distribution of electrical potential in said space is such as to reflect ions isochronously in a flight direction causing them to undergo periodic, oscillatory motion in said space, and said magnetic field is in the direction of said flight direction to assist focusing and stabilization of ion motion substantially mid-way between the first and second arrays of electrodes and wherein at least one electrode of said arrays is connected to amplifier circuitry for detection of image current having frequency components related to the mass-to-charge ratio of ions undergoing said periodic oscillatory motion in said space between the first and second arrays of electrodes.

BRIEF DESCRIPTION OF THE DRAWINGS

In order that invention may be more readily understood, reference will now be made, by way of example only, to the following drawings, in which.

DETAILED DESCRIPTION OF EMBODIMENTS OF INVENTION

Figure 1:
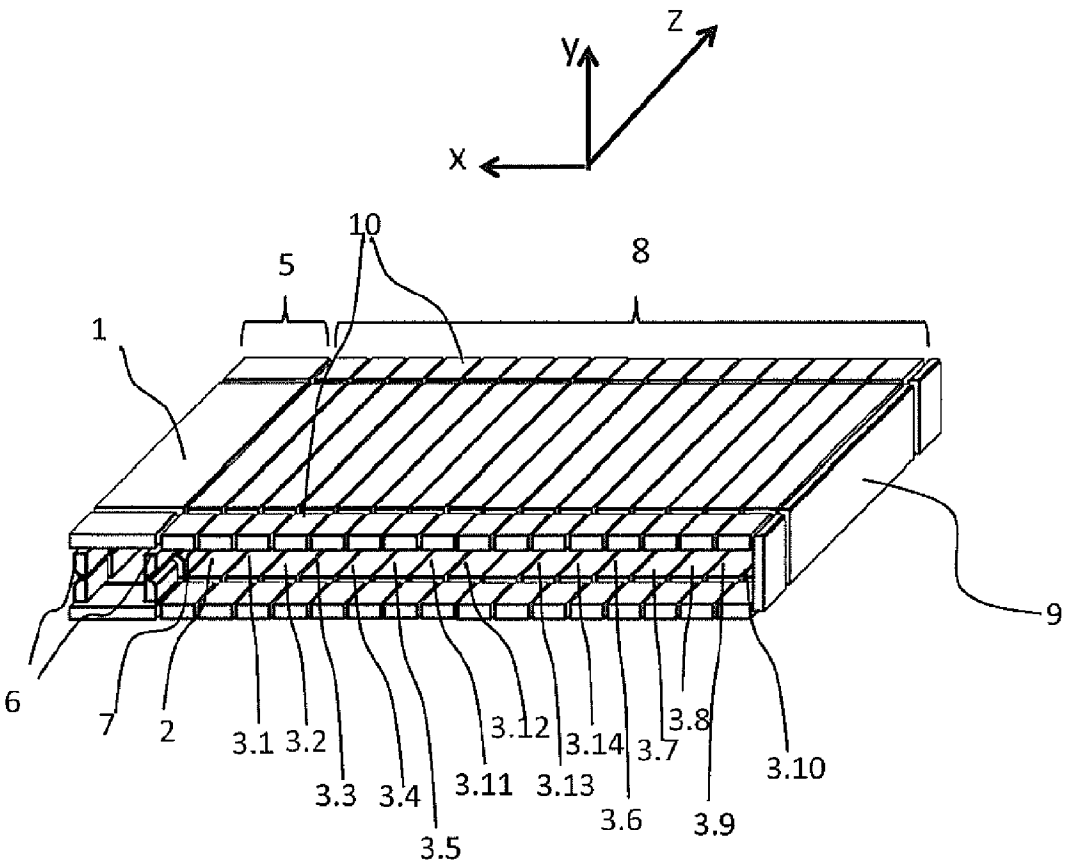
FIG. 1 is a schematic representation of an isochronous electrostatic ion trap mass analyser having a planar configuration and a cooperative rectangular, linear ion trap serving as an ion source.

FIG. 1 illustrates a first embodiment of an electrostatic ion trap analyser according to the invention.

In this embodiment, a planar iso-trap 8 is integrated with a rectangular linear ion trap 5, which functions as an ion source of the analyser. The entire system is constructed on two parallel, electrically insulating plates with multiple strip electrodes printed or cut-to-separate on respective surfaces of the plates to form respective arrays of electrodes. The electrode patterns at the top and bottom surfaces of the plates are substantially the same and are supplied with substantially the same pattern of voltage; that is, corresponding pairs of strip electrodes, with one electrode of a pair from each array, are supplied with the same voltage and are aligned so as to create a field structure that is symmetrical about the central plane, mid-way between the electrode arrays. Because of the symmetry, the electrodes on the top and bottom plates in FIG. 1 are ascribed the same reference numbers. There are several vertical walls 6 and 9 defining the regions of linear ion trap 5 and the iso-trap 8. Ions may be generated outside the system by any available ionization method and initially introduced into the linear ion trap 5 along its axis, in the z-axis direction, and temporarily stored and cooled in the linear ion trap. Alternatively, ions may be generated inside the linear ion trap 5 by electron impact with, or photon ionization of neutral analytes introduced into the linear trap volume.

The separation between the linear ion trap 5 and the planar iso-trap 8 can be implemented by means of just one of the X-electrodes 6 of the linear ion trap, which is provided with a narrow slit 7 through which ions are injected into the planar iso-trap 8, and for maintaining a pressure difference between the two trapping regions. There is an additional strip 2 for optimizing the field during ion injection and for providing sufficient isolation between the two traps which may need to be operated simultaneously. Also, there might be an additional, slotted, separation-wall-electrode which, together with electrode 6, allows additional differential pumping to be used. By supplying suitable potentials to these separating strips, they can also be used as ion optical structures to configure the ion beam during introduction into iso-trap 8.

When the linear ion trap 5 operates as both a cooling and storage device, buffer gas at a generally elevated pressure is needed. Typically, pressures from 0.1 to 10 mTorr of He or Nitrogen are used. In contrast to this, iso-trap device 8 requires a very high vacuum to ensure that ions oscillate therein for a long time period. A pressure of about $10^{-9}$ Torr is preferable. In the configuration of FIG. 1, some neutral particles can freely penetrate into the volume of the iso-trap causing a deterioration in performance of the iso-trap as a mass analyser.

A first solution to this problem is to use a pulsed valve for filling the linear ion trap 5. The infused buffer gas can be pumped down quickly after the valve is closed through a pumping channel at opposite ends of the linear ion trap (or other opening made in electrodes, not shown in FIG. 1). A pump down time constant of 10 ms can be achieved, so a pressure below $10^{-7}$ Torr can be achieved in about 100 ms time. The pump down time constant depends on the pumping channel to the linear ion trap (or toroidal ion trap, as explained later). When ions are injected into the iso-trap 8, after such a delay, the gas pressure in the iso-trap would reduce to a satisfactory level, especially when a dual-slit differential pumping structure is used.

Figure 2A:
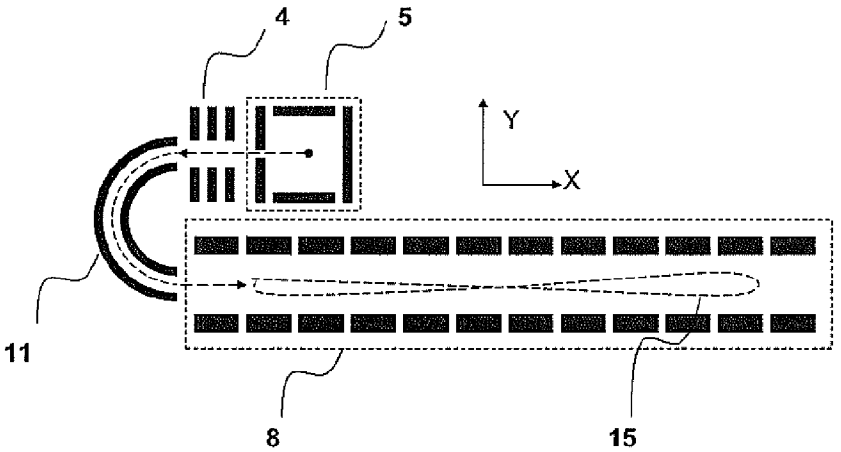
FIGS. 2A and 2B are schematic representations of an isochronous electrostatic ion trap mass analyser connected to a rectangular, linear ion trap via a curved, ion introduction interface, FIGS. 3A and 3B, respectively illustrate ion flight trajectory and distribution of electrostatic potential in the planar iso-trap analyzer.
Figure 2B:
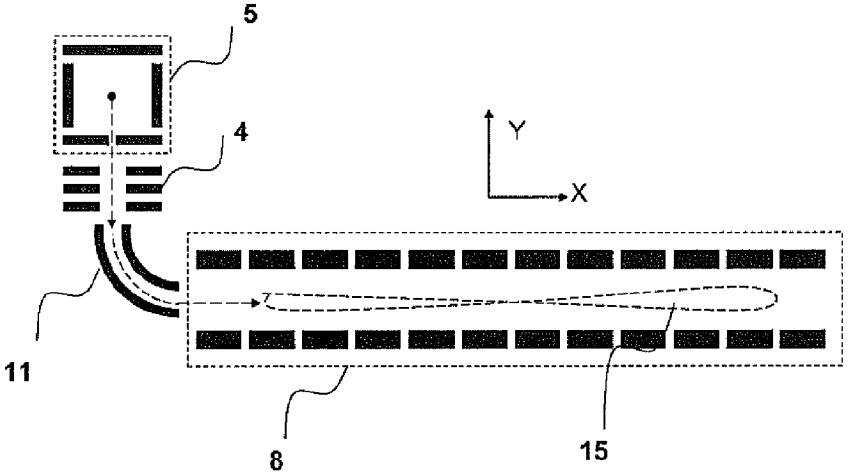

This problem can also be addressed using a configuration of the form shown in FIG. 2A. Here, an ion trap source 5 is connected to a planar iso-trap device 8 via a curved, 2D sector, ion optical element 11. The sector element 11 is comprised of two, curved electrodes elongated along the z-axis direction and having substantially the same cross-section along this direction. The 2D sector element 11 preferably operates in conjunction with a 2D lens 4 positioned between the sector element 11 and the linear ion trap. Such a sector element is just one example of an electrostatic deflector known in the art of ion optics and can be used to deflect an ion beam through a certain angle. Using this element, the ejection slit of the linear ion trap 5 is removed from direct view of the iso-trap's mid-plane where most of the ion motion takes place. Neutral particles in the linear ion trap can no longer penetrate into the iso-trap volume, thus ensuring high vacuum in the iso-trap even when pulsed buffer gas is not used. Different configurations of sector element 11 can be used. The outer electrode may be made of mesh material allowing neutral gas to be pumped out easily. Other bending angles, instead of 180 degrees, such as that shown in FIG. 2B (i.e. 90 degrees) are also possible.

Instead of using a linear ion trap, a linear ion guide may alternatively be used. The linear ion guide may employ a RF guiding field on a D.C. quadrupole field. Such fields (for curved ion guides) are described hereinafter with reference to FIGS. 10 and 11.

Referring again to FIG. 1, the electric field in the planar iso-trap region is defined by the multiple, parallel strip electrodes 3.1, 3.2, . . . 3.8, 3.9, 3.10 and also by pick-up strip electrodes 3.11 to 3.14, as well as vertical electrodes 6 and 9.

During ion injection, the voltages on strip electrodes 2, 3.1, 3.2, 3.3 and 3.4 are lowered so that the positive ions can be transferred into the iso-trap from the linear ion trap. It is preferable, though not always necessary, that the injected ions from the linear ion trap form a first time-focusing point in the central plane, mid-way between the two electrode arrays, just between the pick-up strip electrodes 3.12, 3.13 of the top and bottom electrode arrays.

Once the ions get into the iso-trap, the voltages on strip electrodes 2, 3.1, 3.2, 3.3 and 3.4 should be quickly set to the trapping mode. The voltages on the pick-up strip electrodes 3.11 to 3.14, are normally (though not necessarily) set at zero for ease of connection to the image current amplifier, and the voltage on strip electrodes 3.1, 3.2, . . . 3.8, 3.9, 3.10 can be either positive or negative relative to the voltage on the pick-up strip electrodes 3.11 to 3.14. A typical potential distribution at the central plane is illustrated by trace 18 in FIG. 3B. Such a potential distribution in the x-axis direction creates ion-reflecting fields at opposite ends of the iso-trap where ions are periodically reflected in the x-axis flight direction. The shape of the potential distribution created by the potentials of the ion-reflecting fields is such as to ensure that ions having the same m/z undergo isochronous motion at least in some energy range near the average flight energy. This is achieved by an appropriate selection of voltage supplied to corresponding strips electrodes of the x-axis. These voltages are typically optimized using optimization methods known in the art of charged particle optics. For a preferred embodiment of the current invention, an average flight energy of $E_0$ in range between 3 to 10 keV is feasible. By means of optimization, the periodicity of oscillations of particles having the same m/z can be made substantially independent (isochronous) of flight energy and of their initial locations, within certain ranges. By way of example, isochronous motion can be readily accomplished for particles having the same m/z and having initial energies differing from $E_0$ by no more than +/−2%, and an initial spatial spread no greater than +/−1 mm in each direction.

Figure 3A:
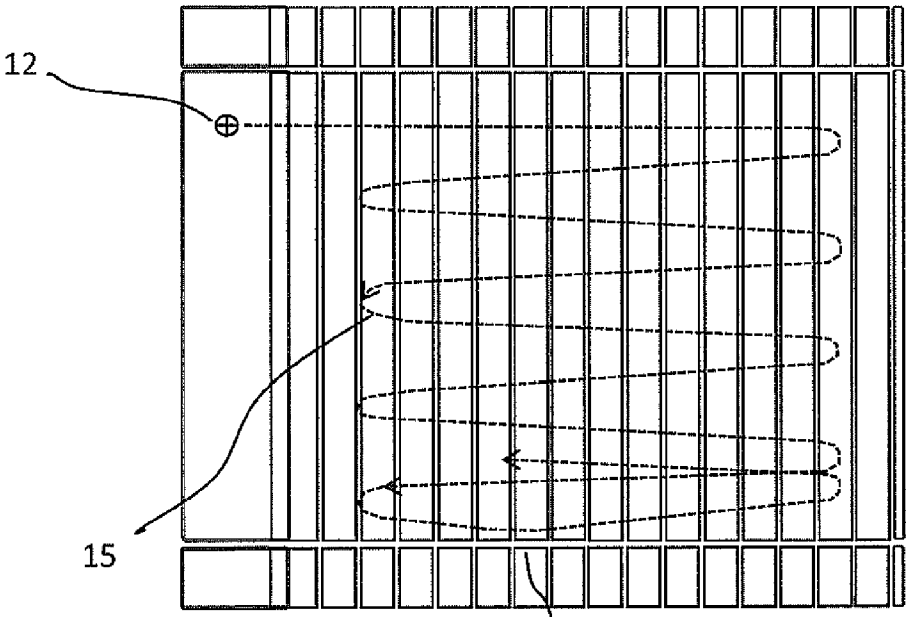
Figure 3B:
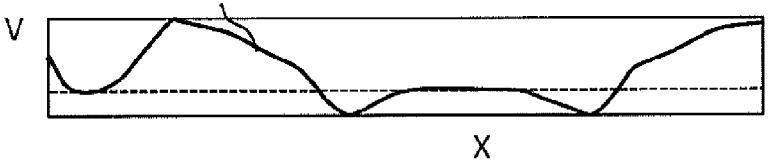

Another function of the electrode arrays of iso-trap is to ensure beam stability in the lateral, y-axis direction. This is again achieved by appropriately shaping the potential distribution created by the strip electrodes of the two arrays. For example, the potential distribution shown in FIG. 3B has negative going potentials, which create a lens effect for motion in the lateral, y-axis direction. Due to this lens effect the beam is periodically focused in the lateral direction and so remains narrow in the y-axis direction around the mid-plane. Lateral beam stability comes as an additional requirement (to energy focusing) during the optimization process, and both can be achieved simultaneously. More details on conditions of lateral beam stability in multi-reflecting systems can be found in A. Verentchikov and M. Yavor, Nauchnoe Priborostroenie, 2004, vol. 14, pp. 46-58 (in Russian). The potential distribution shown in FIG. 3B is presented here by way of example only. Many other potential distribution shapes providing energy isochronous motion and lateral stability at the same time, could be used in the present invention.

Back to FIG. 1, at opposite ends of each main strip electrode 3.1 to 3.10 and 3.11 to 3.14, there are two shorter strip electrodes 10. These are normally charged at a fixed, higher potential than their associated main strip electrodes to form a potential barrier in the z-axis direction. Generally, a 10V DC potential is used in addition to the potential supplied to the ion mirror and pick-up strip electrodes. As shown in FIG. 3A, ions are reflected back as they approach the ends of the main strip electrodes in the drift (z-axis) direction and this effect need not be isochronous. Even ions having the same m/z and the same origin will spread out in the z-axis direction because of their different kinetic energies in the z-axis direction. The extent of the ion clouds in the (z-axis) drift direction is thus determined by the total length of the system in the z-axis direction. This can be as big as 100 mm or even 300 mm. According to the present invention ion clouds will spread out over this distance and will be confined between the two arrays of parallel strip electrodes that define the ion trap volume. By way of comparison, in the known Orbitrap device, ions rotate around the central electrode of the device and over time spread out over a circular region having a diameter of ca. 10 mm. The total length of those clouds is thus only $\pi \cdot 10$ mm≈30 mm. To those skilled in the art, it will be obvious that, in a device of present invention, the ion clouds may be an order of magnitude longer and thus can hold much more charge before the destructive onset of the space charge. Thus, the system of present invention provides a mass analyser with much higher tolerance to space charge effects than the prior art, particularly the Orbitrap.

Figure 4B:
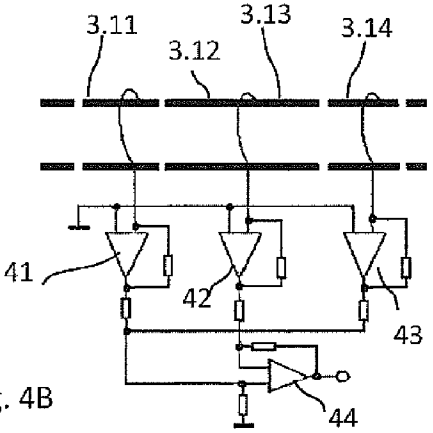
FIGS. 4A and 4B, illustrate two different image current detection circuits
Figure 4A:
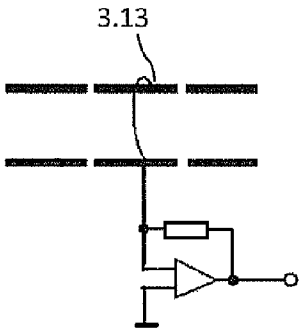
Figure 4C:
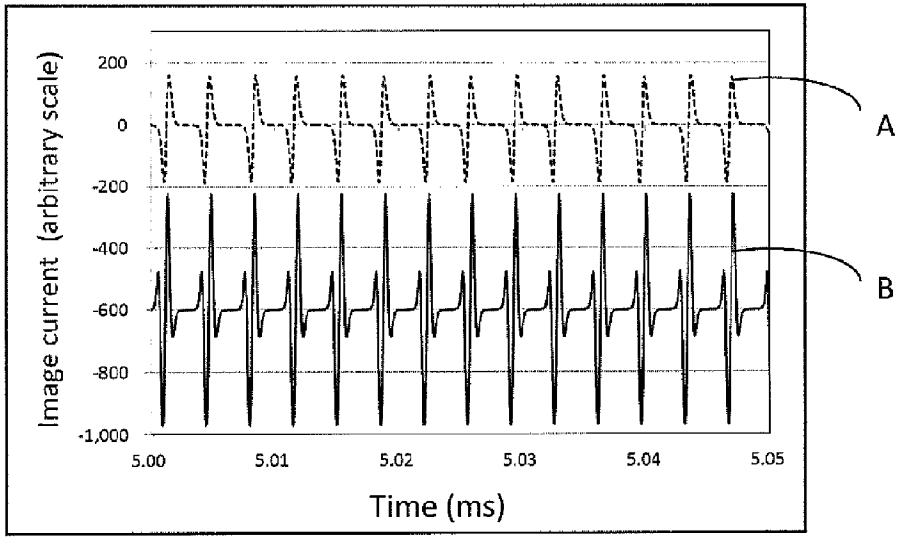
FIG. 4C illustrates their corresponding image current waveforms.

Once the ion cloud starts to oscillate between the two x-axis ion mirrors, it periodically passes through the region between the pick-up strip electrodes 3.11 to 3.14 and induces image current. Each group of ions with a specific mass-to-charge ratio has a specific oscillation frequency. Thus, the image current signal associated with a group of ions will contain fundamental and higher, harmonic frequency components of the oscillation frequency of that group. It is possible to use any one electrode of either array as an image current pick-up electrode. However, it is better to link corresponding pairs of mutually aligned electrodes, with one electrode from each array because, apparently, this produces image current signal having twice the magnitude of image current signal produced using only a single pick-up electrode. FIG. 4A shows an image current detection circuit having a pair of such linked electrodes, 3.13. However, when multiple pairs of linked pick-up electrodes are used, and their image current signals are suitably combined, a higher signal intensity is obtained. FIG. 4B shows an image current detection circuit having multiple pairs of linked electrodes. The image current signal produced by electrode pairs 3.12 and 3.13 (shown connected together) is initially transduced by I-V converter 42 and then supplied to one input of a differential amplifier 44, whereas the image current signals produced by neighbouring electrodes 3.11 and 3.14 are transduced by I-V converters 41 and 43, respectively and summed at the other input to the differential amplifier 44. The differential amplifier 44 then outputs a difference signal by subtracting the summed signal at electrodes 3.11, 3.14 from the signal at electrodes 3.12, 3.13. A simulation was performed for an iso-trap having the same structure as that shown in FIG. 1 using a tightly bunched group of 1000 ions. FIG. 4C shows the image current signals, marked A and B, produced by the image current circuits of FIGS. 4A and 4B, respectively. The traces shown in FIG. 4C were obtained from 50 μs of recorded data with a flight time of about 5 ms. The ion packet was kept tightly bound within this time window and no significant signal decay was observed. It can be seen that when more pick-up electrodes are used a higher average signal intensity results and also the image current output waveforms contain more, higher order, frequency components. Improved sensitivity and mass resolution can be achieved using appropriate time domain image current-to-mass spectrum conversion algorithms. While it is possible to use Fourier transformation to convert the image current signal into a mass spectrum, the multiple, higher harmonic frequency components make the spectrum complicated, especially when a wide range of mass-to-charge ratios is involved. New conversion methods such as pattern matching wavelet method or least square regression can be used to maximize the usage of the detected signal.

Figure 4D:
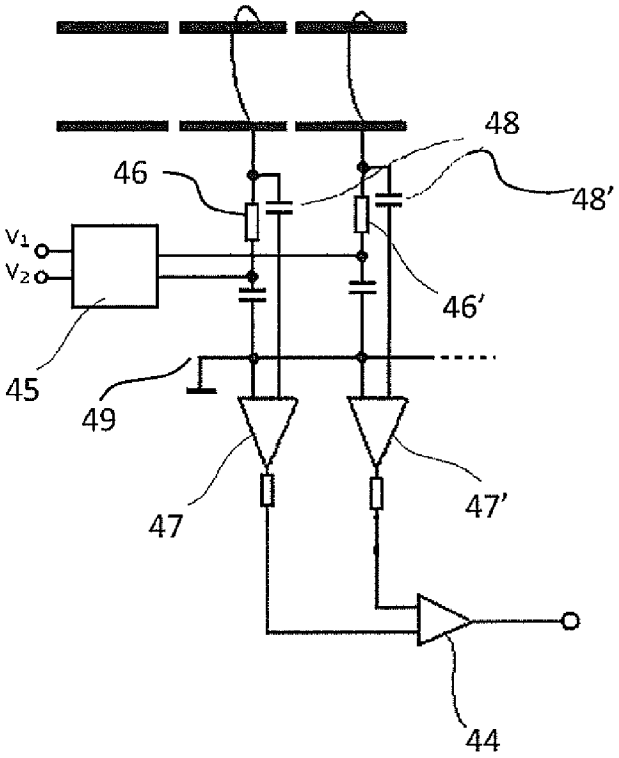
FIG. 4D illustrates another image current detection circuit including a filter circuit.

It is common to select electrodes that are connected to ground potential (as well as electrodes surrounded by electrodes at ground potential) as pick-up electrodes for image current detection. This is done to reduce electrical noise from the power supply. However, this is not necessary if a suitable filter circuit is provided. FIG. 4D shows two pairs of linked, mutually aligned electrodes, with one electrode of each pair from each electrode array. In use, these pairs of linked electrodes are floated at voltages $V_1$ and $V_2$ respectively. These voltages are produced by a power supply (not shown) and are initially filtered using filter circuit 45 to remove electrical noise before being fed to the respective pairs of linked electrodes via respective Mega Ohm resistors 46,46'. Image current detected at each electrode pair is coupled to one input of a respective current-to-voltage converter 47,47' via a capacitor 48, 48', and the two converters share the local ground 49. The converter outputs are supplied to differential amplifier 44 which senses a difference of image current detected at the linked pairs of electrodes and suppresses any common mode electrical noise that may still be present.

Figure 5A:
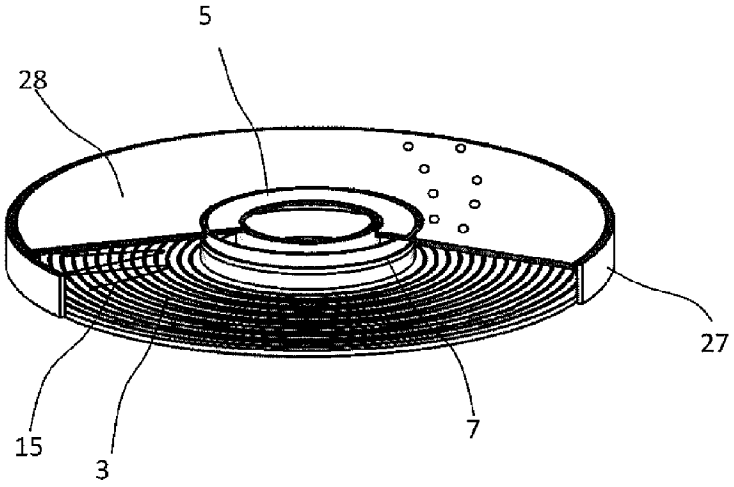
FIGS. 5A and 5B, are schematic representations of a circular electrostatic ion trap mass analyser and a cooperative toroidal ion trap serving as an ion source.
Figure 5B:
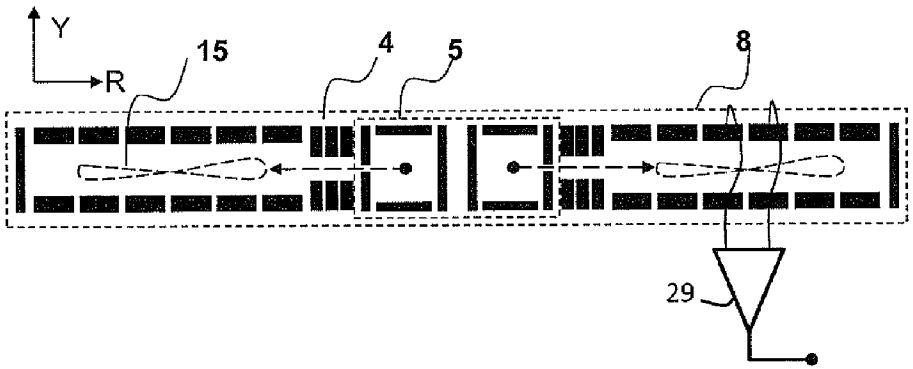

Another embodiment of a planar iso-trap, having a circular configuration is now described. As shown in FIG. 5A, a circular iso-trap 8 includes two planar arrays of field-defining electrodes in the form of circular, concentric electrode strips 3 provided at respective surfaces of two coaxial discs 28. A toroidal ion trap 5 at the centre of this structure has the function of ion source, ion store and of ejecting ions through a slot 7 into the interior of the circular iso-trap 8. The end wall 27 of the iso-trap may be used to define the field near the outside edge and shield the interior from external electric fields. However, in many cases, the end wall 27 may not be necessary as long as the outer ring electrode creates a field distribution that prevents ion penetration. Alternatively, the end wall can be made of metal grids to permit better pumping of iso-trap region 8. FIG. 5B shows a cross-sectional view through the cut-away section of the iso-trap shown in FIG. 5A, although an additional circular lens group 4 is included between the toroidal ion trap 5 and the circular iso-trap 8.

Once the ions have been injected into the circular iso-trap 8, they oscillate in and out in the radial direction, as shown by trajectory 15. Drift motion causes ions to move slowly in a tangential direction about the central axis of the iso-trap 8. The velocity of ion motion in the tangential (drift) direction is much smaller than that in the radial (flight) direction and the rotational symmetry of the iso-trap allows ion trajectory to be isotropic and so there is no need to provide reflecting electrodes to reflect the drift motion, such as electrodes 10 used in the previous embodiment. The image current pick-up electrodes can be any pair of circular electrode strips located on both the top and bottom discs 28. In FIG. 5B, two pairs of circular pick-up electrode strips are used to detect the image current and couple the image current signal to a differential amplifier 29.

Figure 6A:
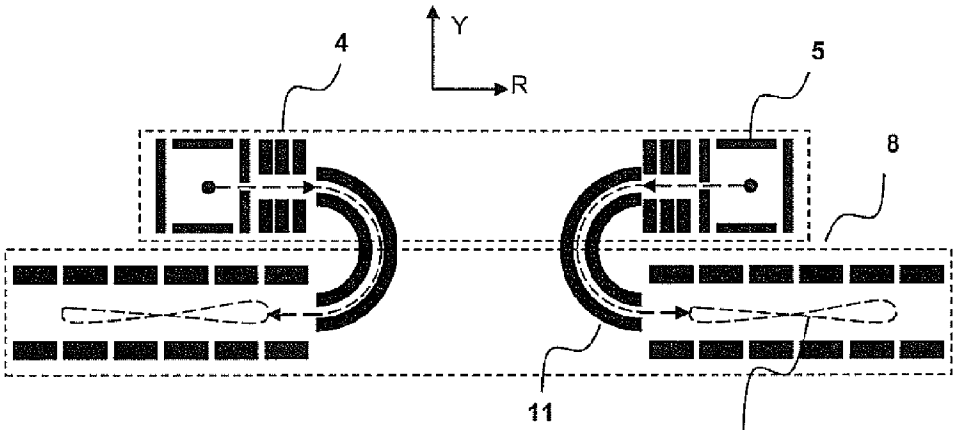
FIGS. 6A and 6B are schematic representations of a circular electrostatic ion trap mass analyser coupled to a toroidal ion trap source via a curved, ion introduction interface.
Figure 6B:
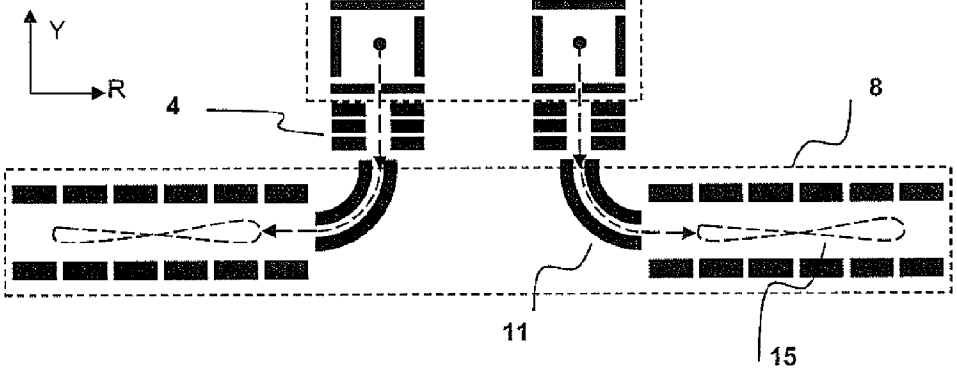

FIG. 6 shows different configurations of circular iso-trap 8 coupled to the toroidal injection ion trap 5 by means of a curved deflector 11. In FIG. 6A, the deflector 11 deflects ions through 180 degrees whereas, in FIG. 6B, the deflector 11, deflects the ions through 90 degrees, but in this case the ejection slit has the form of a circular opening in the bottom electrode of the toroidal ion trap 5. The deflector 11 has the same function as the deflector used in conjunction with the rectangular, planar iso-trap described with reference to FIGS. 2A and 2B; that is, to reduce neutral gas infusion into the iso-trap that would cause harmful collision during ion flight.

Figure 7:
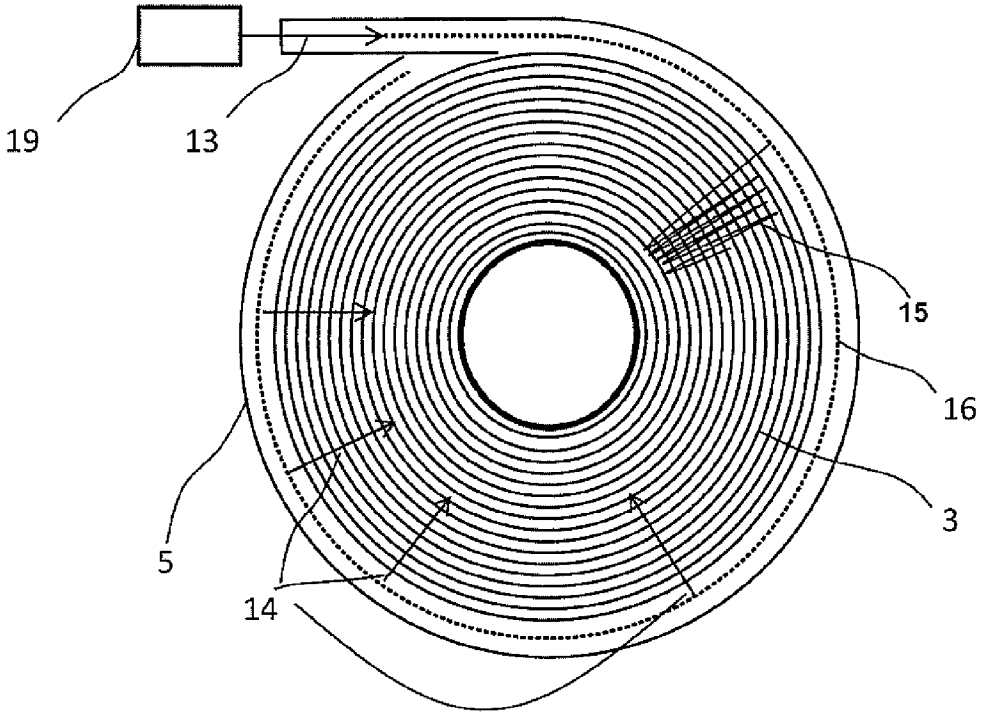
FIG. 7 is a schematic representation of an iso-trap structure where ions are injected from a surrounding injector, ions being transmitted from an external ion source or storage device.

In FIGS. 5 and 6, ions are injected into the iso-trap 8 through the inner, circular ion mirror towards the outer circular ion mirror. Alternatively, it is possible to position the toroidal ion trap 5 outside the iso-trap 8 to inject ions radially inwards towards the interior of the iso-trap, as shown in FIG. 7. In this case, the perimeter of the injector 5 is so large that a large number of ions 16 can be pre-stored therein. Alternatively, ions may be pre-cooled in an additional high frequency confining device 19 and slowly transported to the circular injector 5. Before tangential motion of these ions is removed by further cooling, the ions can be injected into the iso-trap 8 inwardly, as shown by arrows 14. In this case, although the ion cloud density is relatively low because the injector 5 doesn't store ions, the overall size of the injector still allows a sufficient number of ions to be injected into the iso-trap 8.

Figure 8:
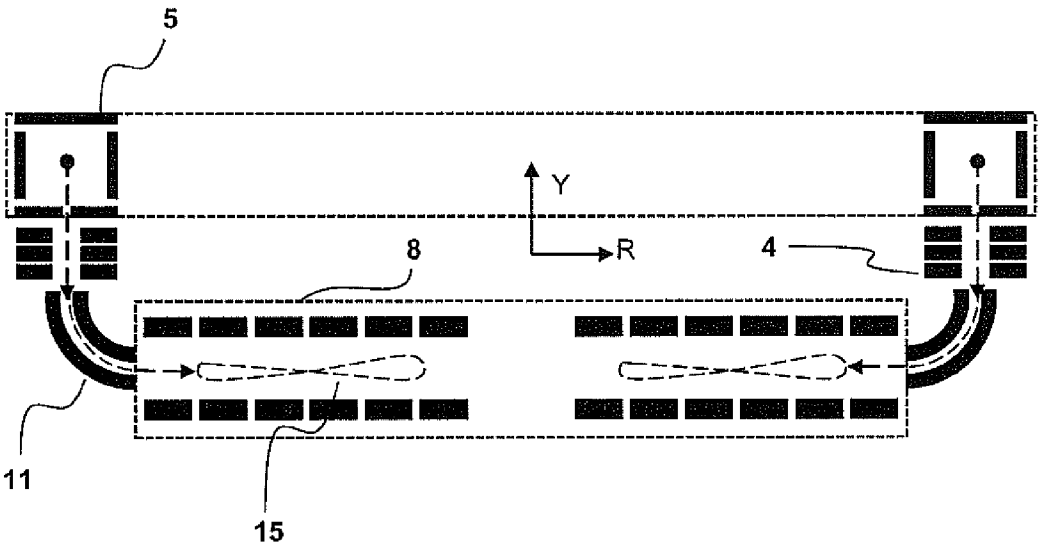
FIG. 8 is a schematic representation of an iso-trap with ions injected from a surrounding injector via a lens and curved deflector.

As before, an additional curved deflector 11 and optional lens 4 may be provided between the toroidal trap 5 and the iso-trap 8, and such a configuration is shown in FIG. 8.

Figure 9B:
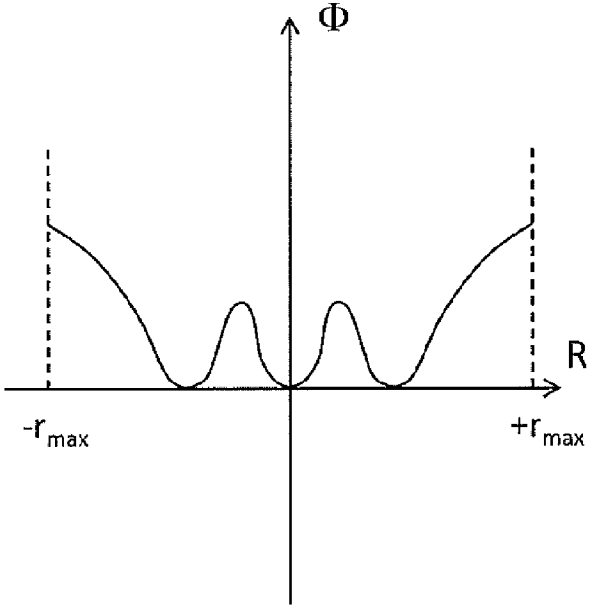
FIG. 9B illustrates a distribution of electrostatic potential at the mid-plane of the iso-trap shown in FIG. 9A.
Figure 9A:
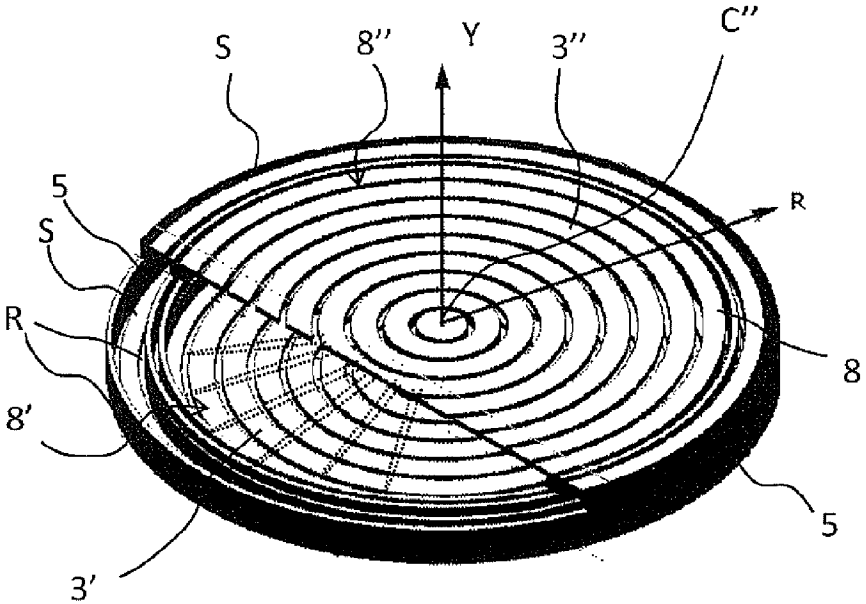
FIG. 9A is a schematic representation of another electrostatic ion trap mass analyzer including an iso-trap having a circular configuration and an associated toroidal ion trap injector.

FIG. 9A shows another embodiment of an iso-trap 8 having a circular configuration. In this case, each array 8',8" of field-defining electrodes has a circular, central electrode C', C" as well as a plurality of concentric ring electrodes 3', 3" located radially outwards of the central electrode. The two arrays are arranged co-axially on the central Y-axis. A toroidal ion trap injector 5 extends circumferentially around the two arrays 8', 8". In this particular embodiment, the ion trap injector 5 extends around the entire circumference of the electrode arrays; that is, the injector 5 subtends an angle of 360° at the centre of the arrays. Alternatively, the ion trap injector 5 may extend only part-way around the circumference of the electrode arrays 8', 8" and may include electrostatic reflectors that create potential barriers at opposite ends of the injector to reflect ions back towards the middle of the injector.

Ions are cooled and stored in the ion trap injector 5 and so have no significant tangential velocity component i.e. a velocity component orthogonal to the radial direction. The stored ions are then injected radially inwards into the iso-trap 8 via a slit in the injector wall.

The distribution of electrostatic potential in the space between the electrodes arrays 8', 8" is such that the injected ions are trapped, undergoing periodic, oscillatory motion on diametral trajectories. More specifically, injected ions are isochronously reflected at diametrically opposite ends of their trajectories (at $r_{max}^{+}$, $r_{max}^{-}$) and pass through the central Y-axis, focused at the mid-plane, equidistant the two electrode arrays 8', 8". To that end, the electrodes of the first array 8' and the electrodes of the second array 8" are supplied, in use, with the same pattern of voltage to create an electrostatic field in the space between the arrays that has 3D rotational symmetry about the Y-axis. By way of example, the distribution of electrostatic potential in that space may be expressed as a solution to Laplace's equation for a 3D rotationally symmetric field, and has the form:

$$\Phi(\rho, \vartheta) = \sum_{n=0}^{\infty} \frac{A_n}{r_0^n} \rho^n P_n(\cos\theta)$$

Where $\rho=\sqrt{y^2+r^2}$, y being distance along the Y-axis direction and r being distance in the radial direction, $$\cos\theta = \frac{y}{\sqrt{y^2+r^2}}$$

and $P_n$ are the Lagrange polynomials.

FIG. 9B is a plot of electrostatic potential Φ as a function of radial distance r at the mid-plane (y=0) obtained using this equation.

With this form of electrostatic potential distribution, ions are reflected by the relatively high potential at diametrically opposite ends (at $r_{max}^{+}$, $r_{max}^{-}$) of their trajectories and ion stability in the Y-axis direction is achieved by the variation of potential in the radial direction. Other suitable distributions of electrostatic potential providing isochronous oscillations on diametral trajectories and ion stability in the Y-axis direction will be apparent to persons skilled in the art.

As in the case of the embodiments described with reference to FIGS. 7 and 8, the ion trap injector 5 has a rectangular or square transverse cross-section comprising four mutually orthogonal electrode plates; that is, a pair of coaxial, cylindrical plates R ("radial" plates) centered on the Y-axis and a pair of coaxial, annular plates S ("sector" plates) that lie in respective planes orthogonal to the Y-axis.

In this embodiment, the ion trap injector 5 is supplied with neutral cooling gas, such as He or $N_2$, and both pairs of electrode plates are supplied with a rectangular wave high frequency signal to create a quadrupole trapping field inside the injector. More specifically, the sector plates are supplied with negative and positive voltages alternately, whereas the radial plates are supplied with positive and negative voltage alternately, in anti-phase to voltage supplied to the sector plates. The resultant high frequency quadrupole trapping field causes ions to undergo cooling and focuses ions at, or close to, the curved longitudinal axis of the ion trap injector without any significant tangential velocity component in the longitudinal axial direction of the injector. The stored ions are injected into the iso-trap 8 via a slit in the inner radial plate by application of a pulsed DC voltage drop across the radial plates. The rectangular wave signal may be turned off while the pulsed DC voltage drop is being applied.

The neutral cooling gas needs to be at an elevated pressure, typically in the range from 0.1 to 10 mTorr, whereas the iso-trap 8 requires a much lower pressure, typically $10^{-9}$ Torr. This pressure differential may give rise to a problem because neutral particles may enter the iso-trap 8 via the injector slit causing a deterioration in performance. As described earlier, this problem can be alleviated by supplying a pulse of cooling gas to the injector and then pumping the gas down quickly to a pressure more compatible with that of the iso-trap. Alternatively, stored ions may be injected into the iso-trap via an intermediate electrostatic deflector, such as a 90° or a 180° sector, of a form described with reference to FIG. 8, for example. This has the effect of reducing gas infusion into the iso-trap 8 that would otherwise cause unwanted collisions during ion flight in the iso-trap.

The central electrodes C', C" and, optionally, at least one adjacent ring electrode are connected to amplifier circuitry to detect image current created by ions as they pass back and forth on their diametral trajectories in the space between the electrode arrays 8', 8". Such amplifier circuitry may be of the form described with reference to FIGS. 4*a* to 4*d*.

In this embodiment, the central electrodes are chosen as pick-up electrodes for image current detection because the highest charge density occurs at the centre of the arrays, thereby maximizing the detected signal intensity, and yet parasitic noise is limited by the smaller area of the central electrodes. Nevertheless, because ions that have the same mass-to-charge ratio all pass through the central Y-axis of the arrays at the same time, even though they may be injected into the iso-trap at different points around the circumference of the electrode arrays, the resultant high charge concentration at the centre might give rise to undesirable space-charge interactions/collisions which could distort the trajectories of ions at the centre giving rise to erroneous or misleading image current measurements.

Figure 10B:
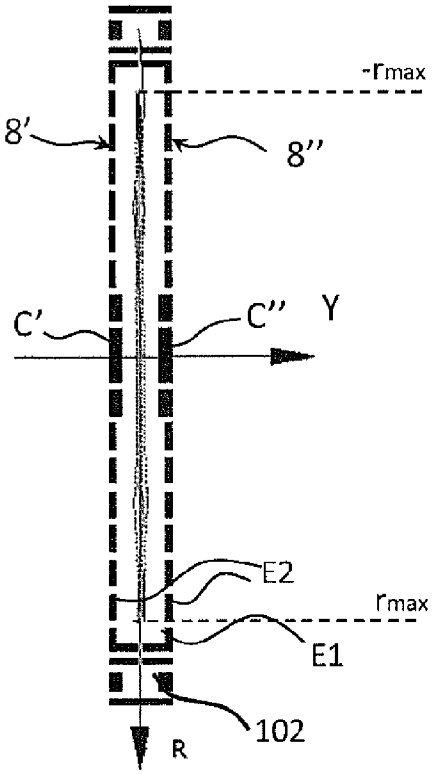
FIGS. 10A and 10B are respectively plan and transverse sectional views of another electrostatic ion trap mass analyzer in which ions follow orbital trajectories which precess around the central axis.
Figure 10A:
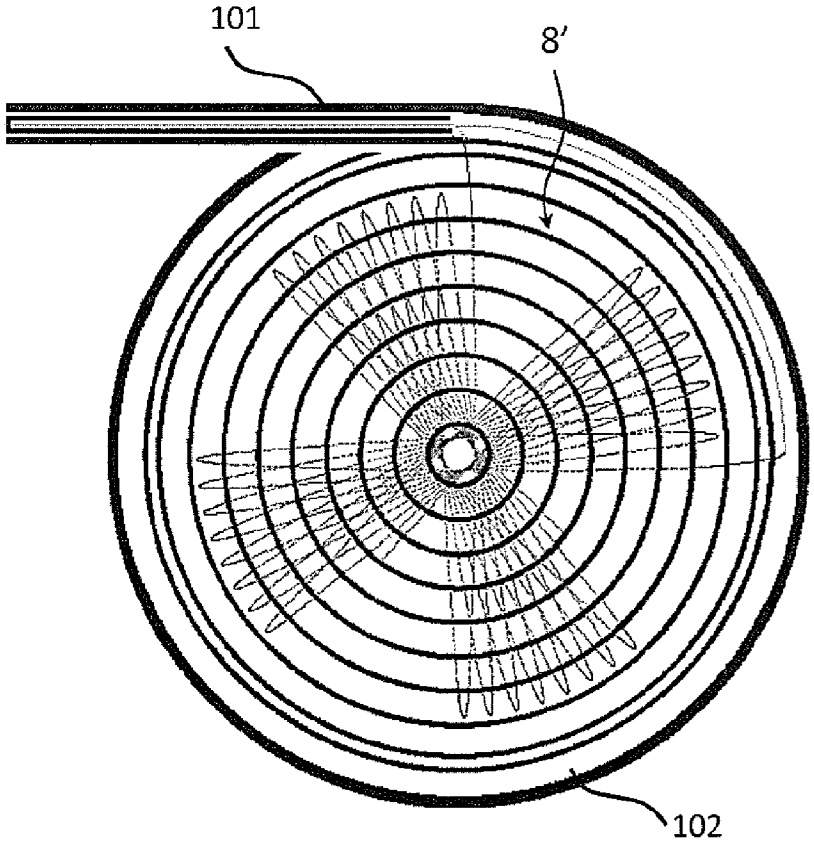

With a view to alleviating this problem, in another embodiment, ions are arranged to have a finite tangential velocity component; that is a velocity component orthogonal to the radial direction, when the ions are injected, radially inwards, into the space between the electrode arrays 8', 8" of the iso-trap 8. The distribution of electrostatic potential between the two electrode arrays 8', 8" is the same as that described with reference to FIGS. 9A, and 9B. As before, the injected ions undergo periodic, oscillatory motion in the space between the electrode arrays and are reflected isochronously at opposite ends of their trajectories. However, with a finite tangential velocity component, ions follow near-diametral trajectories; that is, they follow orbital trajectories which precess around the Y-axis, as shown in FIGS. 10A and 10B. The trajectories pass through, or near to, the mid-plane at the extremities of each oscillation (at $r_{max}^{+}$, $r_{max}^{-}$) and pass close to, but do not intersect, the Y-axis at the centre of the arrays. Simulations have shown that ions having an initial tangential energy component of less than 10 eV will follow trajectories that precess around the Y-axis at a radial distance from the axis of only a few millimeters for electrode arrays 180 mm in diameter. While this is sufficient to significantly reduce space-charge interactions/collisions at the centre of the iso-trap 8, image current can still be detected there without significant reduction.

Referring again to FIG. 10A, in order to create a finite, tangential velocity component, a separate up-stream ion guide 101 is used to pre-cool ions supplied by an ion source (not shown). The up-stream ion guide 101 is located in a region of elevated gas pressure and is supplied with a sinusoidal wave RF signal, creating a RF quadrupole field in the ion guide that is effective to collisionally cool ions that have been supplied by the ion source. Instead of supplying a sinusoidal wave RF signal to the ion guide 101, a rectangular wave, high frequency digital signal could alternatively be used. The cooled ions, which may have a kinetic energy of less than 1 eV, are then accelerated axially into the curved ion injector 102 by application of a DC potential drop (typically in the range 2V to 20V) between the upstream ion guide 101 and the injector 102. Preferably, ions have a pre-determined kinetic energy in the axial direction of injector 102 in the range from 0.04% to 1.0% of the maximum kinetic energy of ions in the flight direction of the iso-trap 8, and most preferably in the range from 0.04% to 0.4%. Fringing fields between the ion guide 101 and the injector 102 need to be carefully controlled so that there is little or no lateral acceleration in directions transverse to the longitudinal axis of the ion guide 101, to prevent the ions from heating up as they are being transferred to the injector 102. The ion injector 102 is located in a low pressure region and, before injection, is also supplied with a sinusoidal wave RF signal (or, alternatively, a rectangular or square wave high frequency digital signal) which is desirably phase-locked to the signal supplied to the up-stream ion guide 101. This signal creates a RF (or high frequency) quadrupole field within the ion injector which is effective to focus ions at, or close to, the curved longitudinal axis of the ion injector 102 and so reduce lateral dispersion of the ions as they travel circumferentially along the length of the injector. The lighter ions have higher axial velocities than the heavier ions and so progressively move ahead of the heavier ions, over time, as they travel along the ion injector 102. Therefore, if ions are pulse-fed into the ion injector 102 from the up-stream ion guide 101, the mass distribution of ions within the ion injector 102, prior to injection into the iso-trap, is time dependent. With this arrangement, ions at the low mass end can travel around the entire circumference of the ion injector 102 when the injection pulse is applied. In effect, the ion injector 102 is operating in the manner of an ion guide with high frequency focusing.

Figures 11A, 11B, 11C:
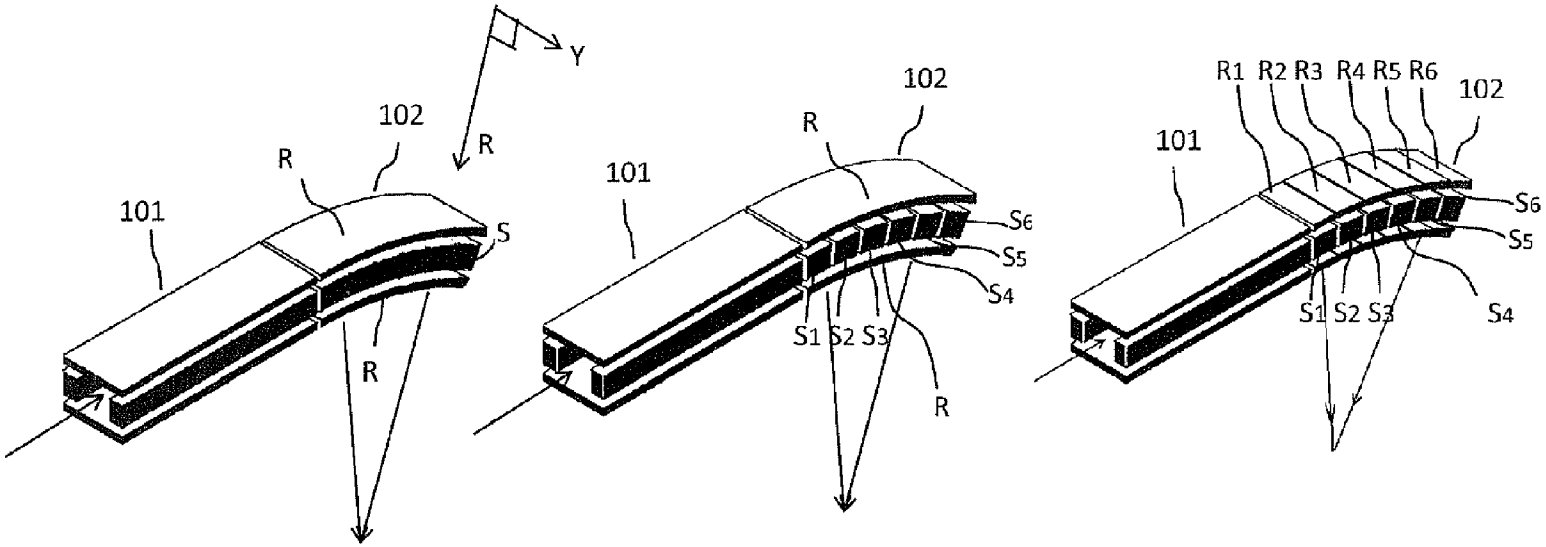
FIGS. 11A, 11B and 11C are perspective views of different ion guide injectors, each coupled to an up-stream ion guide where pre-cooling of ions takes place.

FIG. 11A illustrates, by way of example, a curved ion guide injector 102 which is arranged to extend only part-way around the circumference of the iso-trap 8, subtending an angle of about 30° at the centre. As explained, when ions are pulse-fed from the up-stream ion guide 101 the mass distribution of ions within the ion guide will be time dependent and so the timing of pulsed ion injection determines the mass range of ions injected into the iso-trap 8 for analysis. For example, pulsed injection may be delayed until lighter ions have exited the distal end of the ion guide, leaving only heavier ions for injection into the iso-trap 8. In this manner, a desired mass range can be selected for analysis in the iso-trap 8 thereby reducing the amount and/or complexity of processing needed to convert the detected image current into a mass spectrum and/or controlling the number of ions injected into the iso-trap with a view to avoiding undesirable space-charge effects.

However, ions can alternatively be continuously fed from the up-stream ion guide, and in such case the mass dependency to the time of ions in the ion injector is not obvious.

With the arrangement shown in FIG. 11A, it is preferable (though not essential) to supply the up-stream ion guide 101 and the ion guide injector 102 with a square or rectangular waveform high frequency digital signal because this form of signal is better suited to rapid switching between a transmission state, when ions are traveling along the ion guide injector, to an injection state, when the ions are injected from the ion guide injector into the iso-trap 8, using fast, MOS FET switches.

In one implementation, the rectangular or square wave high frequency digital signal is supplied to the sector plates S, whereas the radial plates R are supplied with the same DC voltage in the transmission state which is rapidly switched to provide a pulsed DC bias voltage across the radial plates in the injection state. The following Table illustrates, by way of example, voltage settings (in volts) that might be applied during the injection state.

TABLE

| Electrodes | $t < t_{inj}$ | $t_{inj} < t < t_{trap}$ | $t > t_{trap}$ |
|---|---|---|---|
| Outer Radial Plate | 4100 | 4100 | 4100 |
| Sector Plates | 4100 + 250 (RF) | 4100 | 4100 |
| Inner Radial Plate | 4100 | 3700 | 4100 |
| Electrode E1 | 3300 | 3300 | 4800 |
| Electrode E2 | 3300 | 3300 | 3300 |

As shown in the Table, the injection state starts at time $t_{inj}$ and ends at time $t_{trap}$ when the iso-trap 8 is restored to a trapping state. The injection state lasts for only a few microseconds during which the heaviest ions need to enter the iso-trap and pass at least the two outer ring electrodes of the electrode arrays (E1, E2 in FIG. 10B) before the lightest ions reach those ring electrodes on the opposite side. At time $t_{trap}$, the voltage on the outermost ring electrode (E1) of the iso-trap 8 is restored to a higher value suitable for the trapping state.

As can be seen from the Table, the potential difference between the inner and outer radial plates of the ion guide injector in the injection state is only 400V, and so the injection field strength between the radial plates is rather low. This is in contrast to a TOF for which a much higher injection field strength is needed so as to eliminate so-called turn-around time. In this invention, a larger turn-around time of up to 100 nsec can be tolerated. Although the resultant ion cloud injected into the iso-trap may be a few millimetres long this does not present a problem because the width of each pick-up electrode is also a few millimeters, and so the length of the ion cloud will not have an adverse effect on mass resolution, provided the total oscillation and measurement time is long enough (typically 5-100 ms). This relaxation of the need to control turn-around time allows lower injection field strengths to be used with the result that ions have a smaller energy spread in the flight direction in the iso-trap. This reduces a requirement to define the field distribution in the iso-trap with a high degree of accuracy that would otherwise be needed to achieve isochronous compensation over a wider energy range, as is the case in a TOF, for example. A voltage difference of only a few hundred volts is sufficient and appropriate such that, during injection, ions acquire a kinetic energy within the injector no greater than 20% of the maximum kinetic energy of ions in the flight direction in the iso-trap.

Although high frequency- or RF-driven ion injectors operate satisfactorily, providing good confinement of ions on, or close, to the longitudinal axis of the injector, a pure DC ion injector could alternatively be used. In this case, referring again to FIG. 11A, DC voltage of one polarity state (positive, say) is supplied to both sector plates S, whereas DC voltage of the opposite polarity state (negative, say) is supplied to both radial plates R, with the voltage supplied to the inner radial plate and the outer radial plate differing in magnitude by a few volts so as to deflect ions along the curved longitudinal axis of the ion guide injector in the transmission state. This arrangement has the drawback that the ion beam disperses very quickly. Especially in the case of lighter ions, the beam front becomes too broad with the result that the efficiency of ion injection into the iso-trap 8 is poor and the energy spread of ions, following injection into the iso-trap 8, is too large.

The curved, DC ion guide injectors shown in FIGS. 11B and 11C are designed to alleviate these shortcomings. Referring to FIG. 11B, the ion guide injector 102 comprises a plurality of segments defined by segmented sector plates, referenced $S_1$, $S_2$ . . . $S_6$. The opposed sector plates of each segment are supplied with DC voltage of the same polarity state, whereas the sector plates of successive segments are supplied with DC voltage of one polarity state and the opposite polarity state alternately so as to create a DC quadrupole field in each segment of the ion guide injector. Thus, segmented sector plates $S_1$, $S_3$ and $S_5$ are supplied with DC voltage of one polarity state and segmented sector plates $S_2$, $S_4$ and $S_6$ are supplied with DC voltage of the opposite polarity state. The DC quadrupole field thus created causes ions to vibrate in both the radial and Y-axis directions to achieve spatial, periodic focusing of ions as they travel along the ion guide injector. This kind of spatial, periodic focusing is independent of mass-to-charge ratio and so the same set of operational parameters will be suitable for ions of all mass-to-charge ratios.

FIG. 11C shows an alternative structure in which the radial plates are also segmented. The opposed radial plates of each segment are supplied with DC voltage of the same polarity state, which will be the opposite polarity state to that of the DC voltage supplied to the sector plates of the same segment. Again, corresponding plates of successive segments are supplied with DC voltage of one polarity state and the opposite polarity state alternately to create a DC quadrupole field in each segment. Thus, segmented radial plates $R_2$, $R_4$ and $R_6$ and segmented sector plates $S_1$, $S_3$ and $S_5$ are all supplied with DC voltage of one polarity state whereas segmented radial plates $R_1$, $R_3$ and $R_5$ and segmented sector plates $S_2$, $S_4$ and $S_6$ are all supplied with DC voltage of the opposite polarity state. With this arrangement, in any one segment, the DC quadrupole field causes focusing of ions in a first direction perpendicular to the longitudinal axis of the injector and causes defocusing of ions in a second direction perpendicular to the longitudinal axis whereas, in the immediately succeeding segment, the DC quadrupole field causes defocusing of ions in the first direction and focusing of ions in the second direction. To create the DC quadrupole field, the polarity states of voltage supplied to respective pairs of opposed plates need also to take account of any offset voltage supplied to the plates. This means that the above-discussed polarities are relative to any offset voltage supplied to all the segmented plates. This arrangement has the additional advantage that the potential distribution along the curved, longitudinal axis of the ion guide injector is substantially constant and so ions will not be subjected to accelerating and decelerating forces as they travel along the injector. Therefore, the precessional motion of ions about the Y-axis, following injection, will be more even and so the isochronous condition will be maintained over a longer flight path.

It will be appreciated that the curved ion guide injectors described with respect of FIGS. 10 and 11 can easily be modified to provide a linear ion guide injector suitable for use with planar iso-traps such as those described with reference to FIGS. 1 to 3.

Although the precessional orbital motion described with reference to FIG. 10A can help to distribute the ion cloud around the mid-plane and the central axis thereby alleviating potential problems due to space-charge interactions/collisions, the orbital pattern resulting from the initial tangential velocity component may give rise to a departure from the true oscillation frequency of ions in the radial direction. The longer the short axis of each orbital trajectory (i.e. the greater the distance between that trajectory and the central Y-axis) the shorter the oscillation period, and so a higher frequency of image current will be detected.

It is possible to compensate for this departure from the true oscillation frequency by varying the profile of the potential distribution around the centre of the trapping field; for example, application of a positive potential slope as a function of distance in the radial direction within a circular region of radius $r_1$ that substantially matches the radius of the central pick-up electrode, such that $dV/dr|_{r1>r>0}>0$, can help to alleviate this problem. This modification of electric field near the centre of the iso-trap provides time focusing that compensates for differences of precessional orbital pattern caused by a spread of initial tangential velocity component.

Figure 13B:
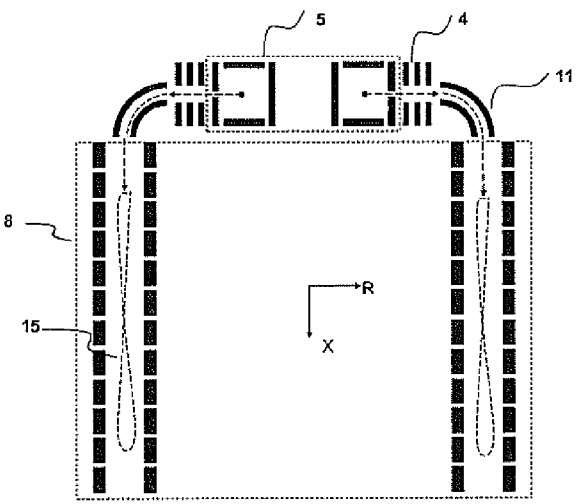
FIGS. 13A and 13B are schematic representations of curved ion introduction interfaces for use with a cylindrical electrostatic ion trap mass analyser coupled to a toroidal ion trap source.
Figure 13A:
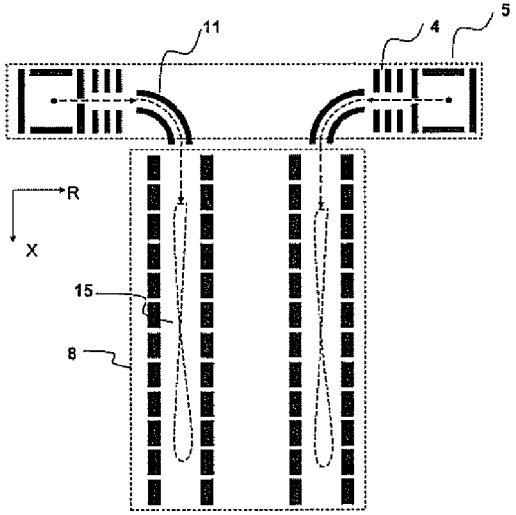

In another embodiment of the invention, the two electrode arrays of iso-trap 8 arc configured to conform to inner and outer coaxial cylinders, or part (e.g. half) cylinders to form a full, or part columnar structure, respectively. A full columnar structure is illustrated in FIG. 9, and is hereby called a cylindrical iso-trap 8. The injector 5 can still be the toroidal ion trap, with an optional through-lens 4, and ion clouds of doughnut shape may be injected into the cylindrical iso-trap 8, where they then oscillate up and down (with a trajectory referenced 15) between the inner and outer electrode arrays, both formed by a series of coaxial ring electrodes. The ejection slit has the shape of a circle cut into the bottom electrode of the toroidal ion trap 5. As before, in order to reduce the gas pressure load in the cylindrical iso-trap 8, a rotationally symmetric deflecting lens can be positioned between the toroidal trap 5 and the iso-trap 8. Such a design is depicted in FIG. 13A and FIG. 13B.

Figure 14:
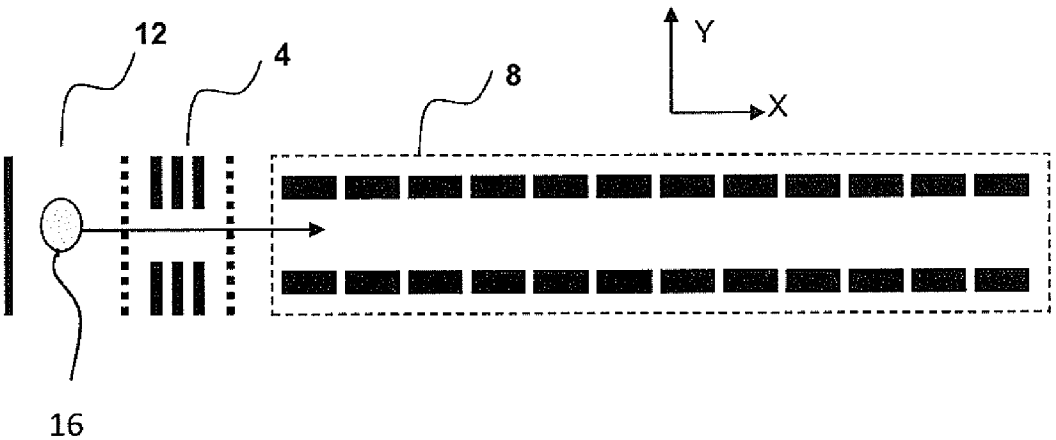
FIG. 14 is a schematic representation of an isochronous electrostatic ion trap mass analyser having a planar configuration and a cooperative ion pulser serving as an ion source.

As already described with reference to FIG. 7, the iso-trap may be coupled to either an ion storage device or to any other pulsing device that can be used as an ion injector. FIG. 14 shows yet another embodiment of the invention wherein the isochronous electrostatic ion trap mass analyser 8 has a planar configuration and is coupled to an ion pulser 12. The pulser 12 may be connected to an upper stream ion guide. Initially, ions generated in an ambient ion source pass through several stages of differential pumping and continue into the ion guide (not shown), where motion in the transverse direction is damped out by collisional cooling. Ions exiting the ion guide, form a narrow beam 16 inside the pulser 12. The pulser is then energized to eject ions from beam 16 and voltage supplied to electrodes at the entrance end of the iso-trap 8 is reduced. After a short period of time, when all ions have entered the iso-trap 8, the voltage supplied to the electrode arrays of the iso-trap is quickly restored so that ion oscillatory motion is established.

Figure 15A:
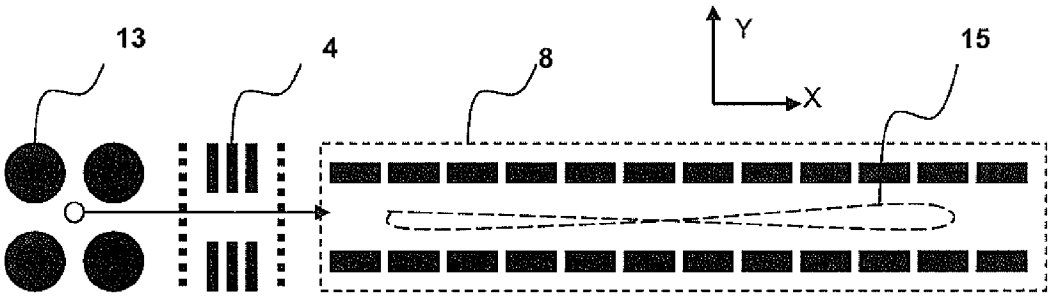
FIGS. 15A and 15B are schematic representations of an isochronous electrostatic ion trap mass analyser having a planar configuration and a cooperative ion guide providing orthogonal ejection and serving as an ion source.
Figure 15B:
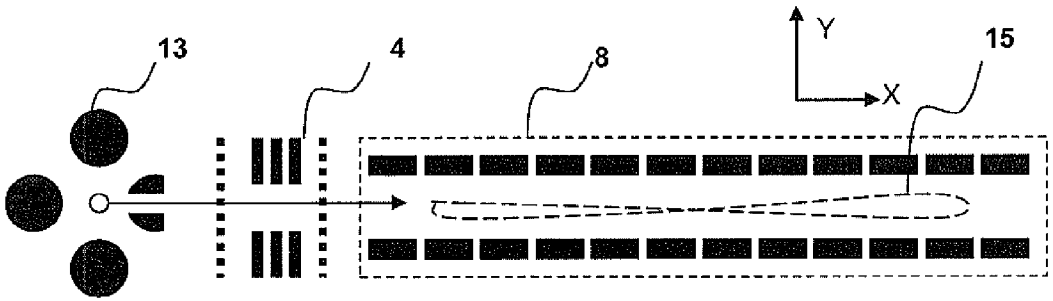

FIG. 15 is a schematic illustration of an iso-trap mass analyser 8 having a planar configuration which is coupled to an ion injector in the form of an ion guide 13 from which ions can be ejected orthogonally in the x-axis direction. This ion guide may be an extension of the cooling ion guide mentioned in the above embodiment, or may be completely separate, located in a higher vacuum environment. The injection path towards the iso-trap 8 can be either via the gap between two rods of the ion guide, as illustrated by FIG. 15A, or through a slot cut into one of the rods, as shown in FIG. 15B.

Figure 16A:
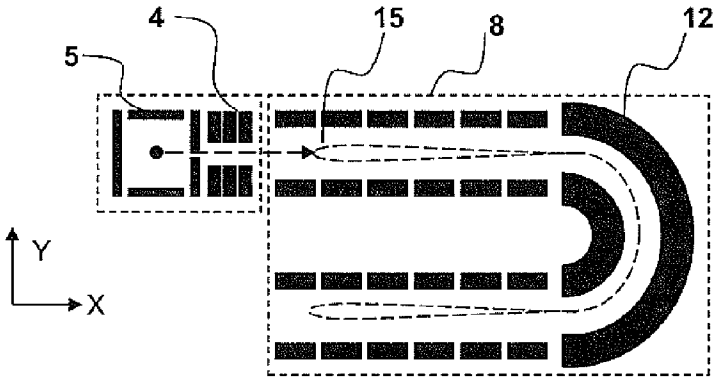
FIGS. 16A and 16B are schematic representations of an isochronous electrostatic ion trap mass analyser having a planar configuration including two planar ions mirrors connected by an electrostatic deflector in the form of a 2D sector.
Figure 16B:
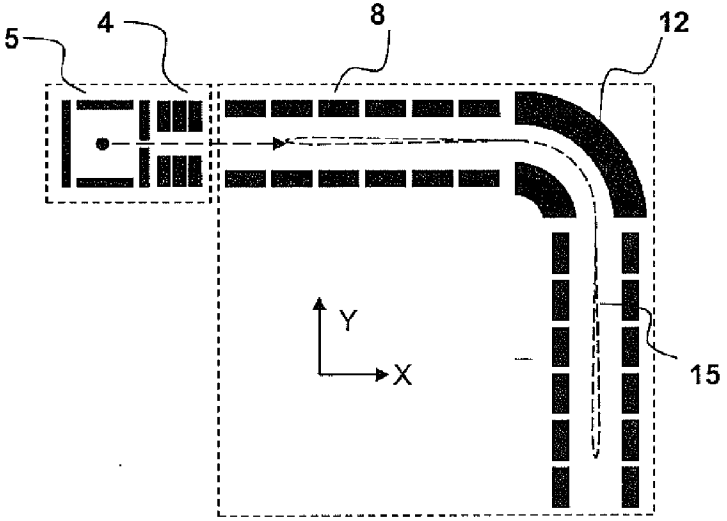

An isochronous electrostatic ion trap (iso-trap) can be formed in various ways. We have illustrated a basic configuration in which ions are trapped between two electrode arrays that are supplied with substantially the same voltage pattern or, in other words, there is no need to supply a voltage offset between the two arrays. However this basic configuration could be combined with other electrostatic lens configurations to create additional configurations of iso-trap, making use of some of the strip electrodes in the system as image current pick-ups. FIGS. 16A and 16B show two examples where an electrostatic deflector 12 is used to connect two parts of a planar iso-trap 8, each part having a respective ion mirror. Such variations are within the scope of current invention.

Figure 17A:
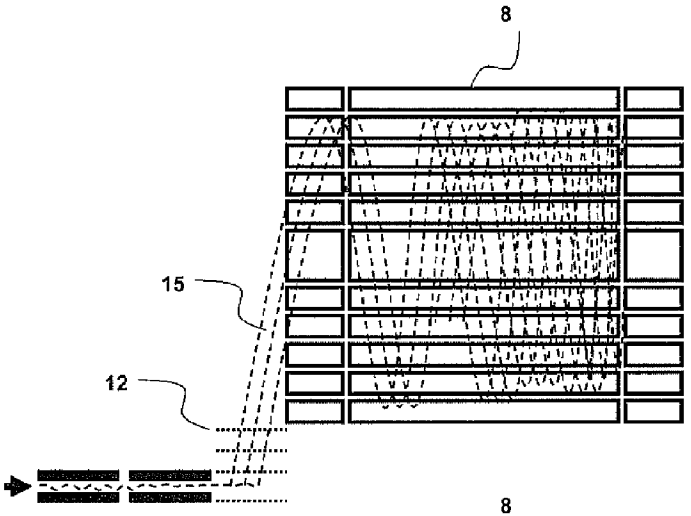
FIGS. 17A and 17B are schematic representations showing ion beam injection into one side of an isochronous electrostatic ion trap mass analyser having a planar configuration using a pulser (FIG. 17A) or a linear ion trap (FIG. 17B)
Figure 17B:
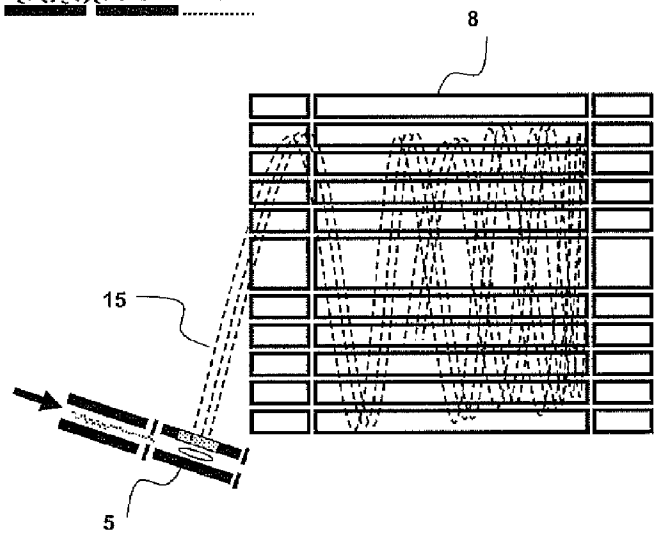

All of the above embodiments have an ion injector to inject ions into the iso-trap through the ion mirror at one end. The ion mirror at this end must be turned off, or the voltage must be lowered, to enable ions to be admitted to the interior of the iso-trap. It is alternatively possible for ions to enter the iso-trap through a side boundary that is parallel to the flight direction. FIG. 17 shows an ion beam being injected from the side into an isochronous electrostatic ion trap mass analyser of planar shape. As before, the injector may be in the form of a pulser, as shown in FIG. 17A or in the form of a linear ion trap as shown in FIG. 17B.

During a period of mass analysis, ions having different masses are oscillating inside the iso-trap, while their image currents are being picked up by the pick-up electrodes. In order to achieve a high signal-to-noise ratio, which, in turn, improves the sensitivity of the device, a high frequency (or RF) voltage supplied to the linear ion trap or toroidal ion trap during the preliminary ion storage stage is preferably switched off. When the measuring cycle is complete, the high frequency signal must be turned on again for the next ion trapping/storing or guiding cycle. To enable such frequent switching of high frequency, high voltage, a digital driving method may be used for driving the trapping potential of the linear or toroidal ion trap.

Figure 12:
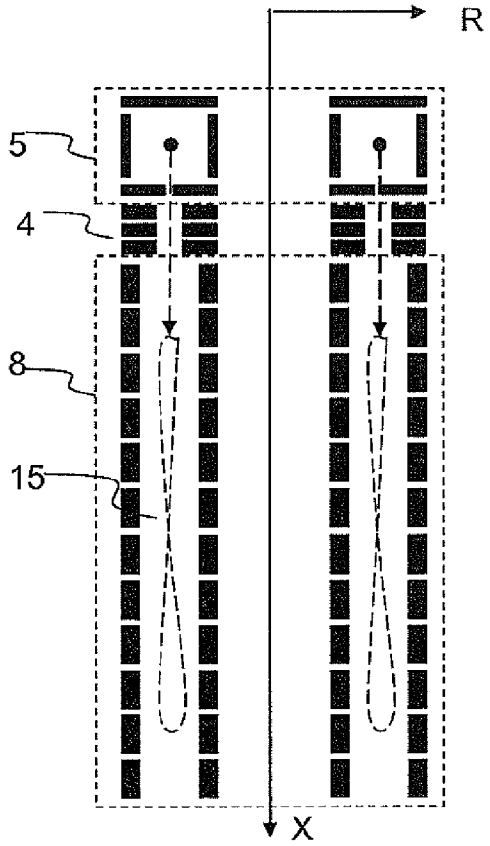
FIG. 12 is a schematic representation of electrostatic ion trap mass analyser having a cylindrical (columnar) configuration coupled with a toroidal ion trap serving as an ion source.
Figure 18B:
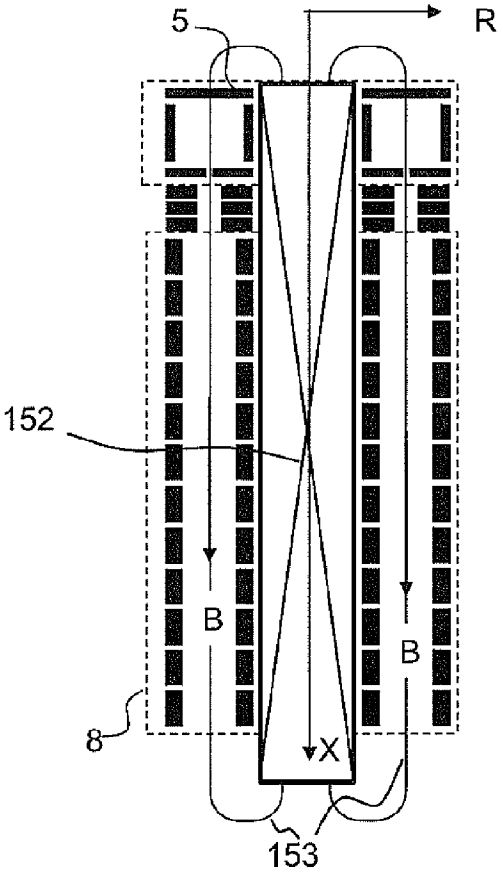
FIGS. 18A and 18B are schematic representations of iso-traps utilizing static electric and static magnetic fields.
Figure 18A:
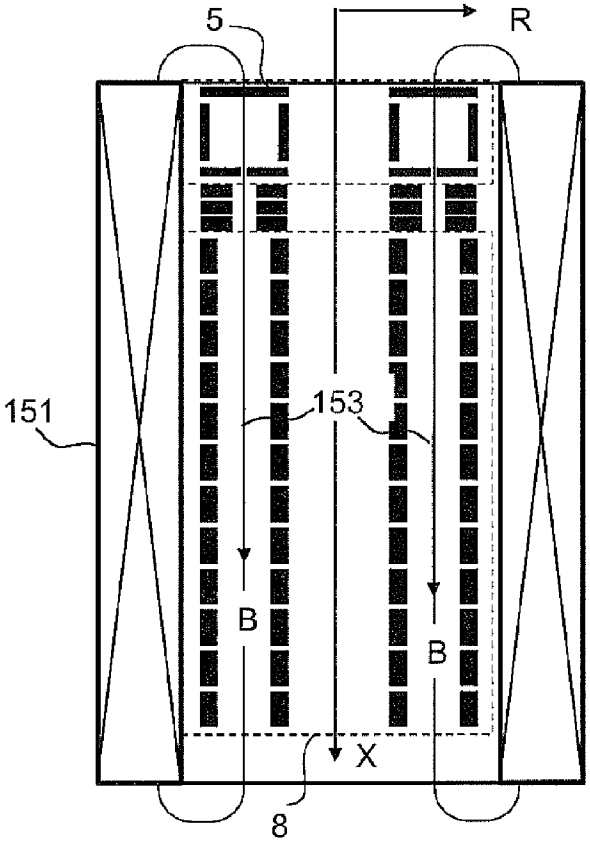

The foregoing embodiments are all examples of electrostatic iso-traps whereby ions are trapped purely by static electric field. It is possible to superimpose a static magnetic field on the static electric field in the direction of isochronous flight (i.e. the x-axis flight direction) to create an electromagnetostatic trapping field. Such iso-traps are referred to herein as electromagnetostatic iso-traps. The magnetic field has little effect on ion motion in the x-axis, flight direction, but assists focusing in the transverse y- and z- axis directions. Therefore, the stability condition in the y- and z-axis directions can be achieved more easily, with reduced disturbance to the isochronous condition in the x-axis, flight direction. FIGS. 18A and 18B show longitudinal cross-sectional views through two examples of electromagnetostatic iso-traps that have cylindrical configurations, similar to that described with reference to FIG. 12. It will be appreciated that the electromagnetostatic iso-trap may have alternative configurations, such as planar configurations similar to the planer configurations described earlier.

Referring to FIG. 18A, two coaxial, cylindrical electrode arrays are located within the central bore of a solenoid 151 which produces a magnetic field B having magnetic field lines 153 that extend in the axial direction in the space between the electrode arrays. The magnetic field has little effect on ion motion in the x-axis, flight direction, but helps to prevent drift in the transverse radial (R) and tangential directions.

As ions are initially cooled down in the toroidal ion trap 5, the velocity component of ions in the radial and tangential directions will be relatively small (much smaller than the rotation velocity of ions in the Orbitrap, for example) even after the ions have been subjected to an extraction process for injection into the iso-trap 8. Therefore, a magnetic field of about 1 Tesla will be sufficient to focus ions substantially mid-way between the two electrode arrays. Accordingly, it becomes much easier to tune the voltage on the electrodes of the arrays to achieve the isochronous condition in the x-axis, flight direction than would otherwise be possible without the assistance of a magnetic field. The solenoid is preferably a superconducting solenoid; however, this is relatively expensive and a cryogenic operating environment is needed. Alternatively, a strong permanent magnet could be used to produce the magnetic field; for example, a cylindrical permanent magnet may he substituted for the solenoid 151 of FIG. 18A or, alternatively, a permanent magnet 152 could be located internally, within the inner electrode array, as illustrated in FIG. 18B. The permanent magnet may be a rare-earth metal based permanent magnet. Of course, both magnets 151 (located around the outer electrode array) and 152 (located within the inner electrode array) could be used in the same structure.

The invention claimed is:

1. An ion trap for mass analysis comprising:

a first array of electrodes and a second array of electrodes, spaced from the first array of electrodes, voltage being supplied, in use, to electrodes of the first and second arrays of electrodes to create an electrostatic field in the space between the electrode arrays, a magnet for superimposing a static magnetic field on said electrostatic field, wherein electrodes of the first array and electrodes of the second array are supplied, in use, with substantially the same pattern of voltage, whereby the distribution of electrical potential in said space is such as to reflect ions isochronously in a flight direction causing them to undergo periodic, oscillatory motion in said space, and said magnetic field is in the direction of said flight direction to assist focusing and stabilization of ion motion transverse to the flight direction, substantially mid-way between the first and second arrays of electrodes;

wherein at least one electrode of said arrays is connected to amplifier circuitry for detection of image current having frequency components related to the mass-to-charge ratio of ions undergoing said periodic oscillatory motion in said space between the first and second arrays of electrodes.

2. The ion trap as claimed in claim 1, wherein said magnet is a superconducting magnet.

3. The ion trap as claimed in claim 1 , wherein said magnet comprises a rare-earth metal based permanent magnet.

4. A method of mass analysis comprising the steps of:

injecting ions into a mass analysis space between first and second arrays of electrodes of an electrostatic ion trap, the first array of electrodes being spaced from the second array of electrodes, supplying substantially the same pattern of voltage to electrodes of the first and second arrays of electrodes to create an electrostatic field in the space between the electrode arrays, and superimposing a static magnetic field on said electrostatic field using a magnet;

whereby distribution of electrical potential in said space between the first and second array of electrodes is such as to reflect ions isochronously in a flight direction causing them to undergo periodic, oscillatory motion in said space, and said static magnetic field is in the direction of said flight direction to assist focusing and stabilization of ion motion substantially mid-way between the first and second arrays of electrodes and wherein at least one electrode of said arrays is connected to amplifier circuitry for detection of image current having frequency components related to the mass-to-charge ratio of ions undergoing said periodic oscillatory motion in said space between the first and second arrays of electrodes.

5. The method of claim 4, further comprising detecting image current on at least one electrode of said arrays, the detected image current having frequency components related to the mass-to-charge ratio of ions undergoing said periodic, oscillatory motion in said space.

* * * * *